US006257185B1

(12) United States Patent
Groh et al.

(10) Patent No.: US 6,257,185 B1
(45) **Date of Patent: *Jul. 10, 2001**

(54) SWITCHABLE CAM FOLLOWER

(75) Inventors: David M. Groh, Troy; Troy Kraemer, South Lyon, both of MI (US); Oliver Schnell, Weisendorf (DE)

(73) Assignee: Ina Walzlager Schaeffler oHG (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/460,748

(22) Filed: Dec. 14, 1999

Related U.S. Application Data

(60) Provisional application No. 60/112,408, filed on Dec. 15, 1998.

(51) Int. Cl.[7] ..... F01L 1/14; F01L 13/00

(52) U.S. Cl. ..... 123/90.16; 123/90.5; 123/90.55; 123/198 F

(58) Field of Search ..... 123/90.15, 90.16, 123/90.48, 90.49, 90.5, 90.55, 198 F

(56) References Cited

U.S. PATENT DOCUMENTS

| | | | | |
|---|---|---|---|---|
| 5,398,648 | * | 3/1995 | Spath et al. | 123/90.16 |
| 5,402,756 | * | 4/1995 | Bohme et al. | 123/90.16 |
| 5,669,342 | * | 9/1997 | Speil | 123/90.16 |
| 5,934,232 | * | 8/1999 | Greene et al. | 123/90.16 |
| 5,960,756 | * | 10/1999 | Miyachi et al. | 123/90.16 |

* cited by examiner

*Primary Examiner*—Weilun Lo
(74) *Attorney, Agent, or Firm*—Bierman, Muserlian and Lucas

(57) ABSTRACT

A switchable cam follower (1) for a valve train of an internal combustion engine, which valve train can be actuated indirectly by tappet push rods, the cam follower comprises an outer and an inner section (4,5) end for switching-off the cam follower (1) from the cam lift, the inner section (5) is pivotable relative to the outer section (4) during a valve lift phase of the cam.

12 Claims, 1 Drawing Sheet

SWITCHABLE CAM FOLLOWER

PRIOR APPLICATION

This application claims the benefit of provisional patent application Ser. No, 60/112,408 filed Dec. 15, 1998.

FIELD OF THE INVENTION

The invention concerns a switchable cam follower for a valve train of an internal combustion engine, which valve train can be actuated indirectly by tappet push rods, said cam follower having the following features:

the cam follower can be installed in driving relationship between a camshaft and an end of the tappet push rod, said cam follower comprising an outer and an inner section as well as coupling means, the outer section can be inserted with its outer peripheral surface into a reception of the internal combustion engine, the inner section being mounted in a recess of the outer section while being movable relative to the outer section, one of said sections has a support for the end of the tappet push rod and the other of said sections has an axially opposite contacting surface for a cam of the camshaft, said sections can be coupled to each other by the coupling means so that on coupling, a high lift of a valve train gas exchange valve loadable by the tappet push rod can be effected and, on uncoupling of the sections by the coupling means, a low lift or a zero lift of the gas exchange valve is obtainable.

BACKGROUND OF THE INVENTION

A cam follower of the pre-cited type known from U.S. Pat. No. 5,361,733 is considered to be of the generic type. This cam follower likewise comprises an outer and an inner section. However, the outer section is configured to be contacted by high lift cams and the inner section, by a low lift cam. Due to this configuration, the cam follower has a relatively large mass which has a negative effect on the oscillating masses in the valve train even in the uncoupled state. At the same time, the cam follower has a large overall width. Moreover, a set of three cams is required for each cam follower. This, in turn, unnecessarily increases the costs of valve actuation on the whole.

OBJECT OF THE INVENTION

It is therefore the object of the invention to create a switchable cam follower of the type described above in which the mentioned drawbacks are eliminated.

SUMMARY OF THE INVENTION

The invention achieves this object by the fact that the outer section comprises the support for the end of the tappet push rod, and the inner section comprises the contacting surface for the cam of the camshaft, the recess for the inner section in the outer section is made pot-shaped, the inner section, at its end remote from the contacting surface in the reception, is provided with an axle which is parallel to the axis of the camshaft and is guided in the outer section, the inner section being mounted on the axle for pivoting relative to the outer section, the inner section is loaded by a spring means against its direction of pivot, and the outer section is made so that it can be guided non-rotatably relative to its reception in the engine block.

By these measures, a switchable cam follower is created whose switching-off member (inner section), in contrast to the state of the art, is not caused by cam lift to move axially relative to the other tappet part (outer section) but pivots relative thereto. This has the advantage over switchable cam followers known from the state of the art that the proposed cam follower has a relatively small overall axial dimension or approximately the same dimensions as an unswitchable cam follower of the prior art. In particular, no design space is required any more in the outer tappet for the hitherto used compression spring.

Preferably, the proposed cam follower is intended to serve for a complete switching-off of the associated gas exchange valve. At the same time, it should be noted that only one cam is required per cam follower and that, advantageously, prior art camshafts can be used if the ramps of the cams are simultaneously raised.

By reason of the construction proposed by the invention, the cam follower possesses only a small oscillating mass in its switched-off state, and this oscillating mass is only minimally increased compared to hitherto known cam followers in the switched-on state. It must also be noted that the overall dimension of the cam follower in radial direction is relatively small.

According to a further proposition of the invention, the axle for the pivotable inner section is configured at the same time as a torsion spring. This reduces the number of components and simultaneously guarantees the relatively compact structure of the cam follower.

Although the invention proposes configuring the coupling means as slides, it is equally possible to use means such as pins, balls and coupling means indirectly actuated through wedge surfaces, and other similar means. Advantageously, the slides are configured as pistons, with their receptions being made as bores.

According to a further feature of the invention, the slides can be displaced in at least one of their directions of displacement by a servo means such as a hydraulic medium. This can be routed, for example, to an outer end face of the slide in question which, in the uncoupled state is situated in the inner section and is biased outwards in opposition to hydraulic medium pressure by the force of at least one compression spring means. However, it is also conceivable to arrange only one slide in the inner section and load this slide in its uncoupling direction by the force of the compression spring means and displace it in its coupling direction by a servo means.

According to a further proposition of the invention, the reception in the outer section extends therethrough and is made, for example, by drilling. This is particularly favorable from the manufacturing point of view. Bushings or stops can be inserted into these receptions to form, on the one hand, displacement limiters for the slides in outward direction, and on the other hand, they can be configured as stops for a rotation of the inner section relative to the outer section. The last-mentioned measures enable a simple positional co-orientation of the receptions of the sections for a displacement of the coupling means in the base circle phase of the respective cam. Thus, for example, a bushing can comprise a radially inwards pointing projection which cooperates with a corresponding track on the outer peripheral surface of the inner section.

According to another feature of the invention, a particularly low-friction cam follower is obtained by the fact that the contacting surface for the cam is configured as a roller preferably supported on a rolling bearing. However, it is also conceivable to use a friction bearing or an intrinsically frictional contact for the cam.

Advantageously, the cam follower comprises a hydraulic clearance compensation means. This dispenses with complicated mechanical clearance adjusting measures. The clearance compensation means is advantageously configured as an integral part of the support for the tappet push rod and arranged in a bore of the outer section.

BRIEF DESCRIPTION OF THE DRAWINGS

The invention is described below with reference to the drawings in which.

DETAILED DESCRIPTION OF PREFERRED EXAMPLES OF EMBODIMENT

Figure 1:
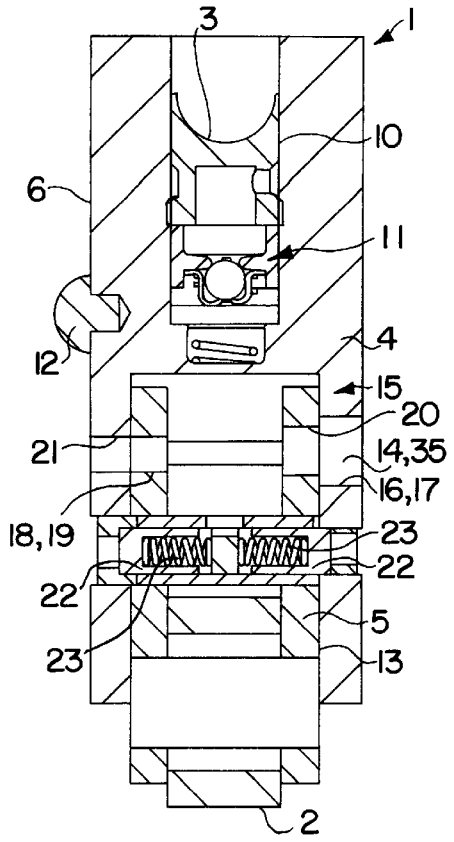
FIG. 1 is a longitudinal section through a cam follower according to the invention.

FIG. 1 shows a switchable cam follower 1 for a valve train of an internal combustion engine, which valve train can be indirectly actuated by tappet push rods. At one end, in the region of its contacting surface 2, the cam follower 1 is loadable in lift direction by a cam of a camshaft, not shown. In the region of another end, the cam follower 1 acts via a support 3 on the end of a likewise not shown tappet push rod. The tappet push rod, in its turn, loads at least one rocker arm.

The cam follower 1 comprises an outer and an inner section 4, 5. The outer section 4 can be inserted for longitudinal displacement with its outer peripheral surface 6 into a reception of the said internal combustion engine.

Figure 2:
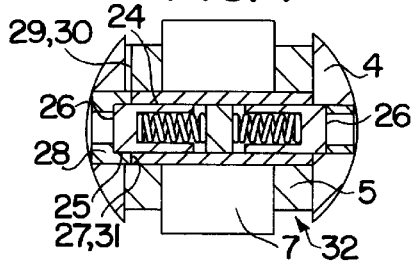
FIG. 2 is a cross-section through the cam follower in the region of its coupling means.

The contacting surface 2 for the cam forms a part of the inner section 5 and is configured in this case as a roller 7 (see also FIG. 2). The roller 7 is mounted for rotation via a rolling bearing 8 on a pin 9 which is fixed in the inner section 5. In the embodiment represented in the drawing, an end region of the inner section 5 comprising the contacting surface 2 projects out of the cam follower 1.

In contrast, the support 3 for the end of the tappet push rod is received in a bore 10 which extends from the other end of the cam follower 1 into the cam follower. The support 3 is a part of a hydraulic clearance compensation means 11 which needs no further description in the present context. The hydraulic clearance compensation means 11 and the support 3 together form a pressure piston.

A body 12 for preventing a rotation of the cam follower 1 relative to its reception in the internal combustion engine is arranged on the outer peripheral surface 6 of the outer section 4. This body 12 can, for example, be a rolling element which projects radially beyond the outer peripheral surface 6. It is also conceivable, however, to arrange a radially inward projecting body in the reception of the internal combustion engine and have this body cooperate with a corresponding longitudinal groove on the outer peripheral surface 6. Alternatively, the outer peripheral surface 6 may comprise appropriate flattened regions which cooperate with opposing flat surfaces of the reception of the internal combustion engine.

To guarantee a switching-off of the associated gas exchange valve by the cam, the inner section 5 is movable relative to the outer section 4 when switching-off is desired. In the prior art, this is achieved in that one of the sections 5 or 4 moves axially relative to the other section 4 or 5. According to the invention, however, it is provided that when a switching-off is desired, the inner section 5 is made to pivot relative to the outer section 4 by cam lift. For this purpose, the inner section 5 is inserted substantially into a recess 13 of the outer section 4, which recess extends from the cam-proximate end into the cam follower 1.

The recess 13 is crossed by an axle 14 which extends diametrically through the cam follower 1. This axle 14 is mounted with its outer regions in the outer section 4. In the region of its end 15 remote from the contacting surface 2, the inner section 5 is arranged on the axle 14.

The axle 14 assumes, at the same time, the function of a torsion spring and comprises on one end, a first rotation preventing device 16 (see also FIG. 5) such as a polygon (in the present case, a square). This rotation preventing device 16 is rigidly arranged in a complementary reception 17 of the outer section 4. In a region at the axially largest distance from the first rotation preventing device 16, there is arranged in the inner section 5, a second rotation preventing device 18 such as a flattened region or a polygon (in the present case, a square). This second rotation preventing device 18 is likewise fixed in a complementary reception 19 of the inner section 5. Relative to further receptions 20, 21, the axle 14 is rotatable. The configuration provided by the invention enables an excellent twist of the axle 14.

Coupling means 22 in the form of slides are arranged axially below the axle 14 in the direction of the contacting surface 2. According to the embodiment of FIG. 1, two coupling means 22 situated opposite each other extend in the inner section 5. Each of these coupling means 22 can be loaded in radially outward direction by the force of a pressure-exerting means 23 such as a compression spring. FIG. 1 shows the coupled state of the sections 4, 5. Radially outwards opposite the coupling means 22 which are situated in receptions 24 (see also FIG. 2) of the inner section 5, receptions 25 are arranged in the outer section 4. These receptions 25 are configured at the same time to serve as displacement limiters for the coupling means 22 in outward direction.

For uncoupling the sections 4, 5, hydraulic medium can be routed to outer end faces 26 of the coupling means 22. The uncoupling of the sections 4, 5 is realized in the base circle phase of the loading cam. If the hydraulic medium pressure is sufficient for displacing the coupling means 22 radially inwards, these extend, at the latest by the end of the base circle phase, entirely in their receptions 24 in the inner section 5. In the cam rise phase, the cam, not shown, pivots the inner section 5 relative to the outer section 4. The axle 14 serves as the center of pivot, while the torsional spring force of the axle 14 holds the contacting surface 2 in constant contact with the cam. When the cam tip runs on, the inner section 5 is pivoted to a maximum relative to the outer section 4. The outer section 4 is not actuated axially in the opening direction of the gas exchange valve which thus remains closed. In the cam drop phase, the pivoted inner section 5 is returned entirely into its recess 13 in the outer section 4 by the torsional spring force of the axle 14 and by the force of gravity.

To limit the pivoting motion in return direction and to guarantee that the receptions 25, 24 for the coupling means 22 are aligned to each other in the base circle phase, the invention provides stop means 27. In the present embodiment, these stop means 27 are constituted by a radially inward projecting part of a bushing 28 which extends in the reception 25 of the outer section 4. For this, an outer peripheral surface 29 of the inner section 5 comprises a corresponding track 30 having a stop surface 31 (see also FIG. 2).

If after the return pivoting of the inner section 5 into its original position, which is reached in the base circle phase of the cam, the hydraulic medium pressure in front of the end faces 26 is reduced to a minimum, the means 23 re-displace the coupling means 22 partially into the receptions 25 in the outer section 4. Thus, when cam lift starts, the cam follower 1, together with the tappet push rod, follows this lift and the associated gas exchange valve opens.

Figure 3:
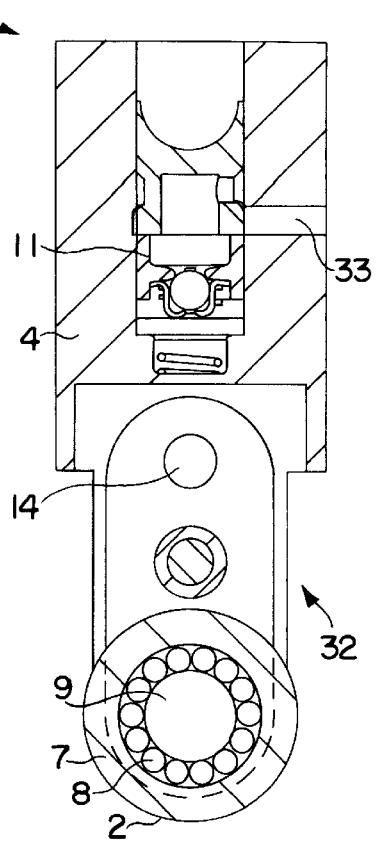
FIG. 3 is a sectional view turned through 90° with respect to FIG. 1.

FIG. 3 shows the cam follower 1 of FIG. 1 in a sectional view turned through 90°. It can be seen that in the region of the inner section 5, the outer section 4 comprises an appropriate recess 32 to guarantee an unobstructed pivoting of the inner section 5 relative to the outer section 4. This recess 32 can be made, for example, by milling. A person skilled in the art will recognize that in the region of the hydraulic clearance compensation means 11, a feed duct 33 in the form of a bore leads radially through the outer section 4 into this clearance compensation means 11. This feed duct 33 communicates with a corresponding supply arrangement for hydraulic medium, for example, an annular groove in the reception of the internal combustion engine. This guarantees the operation of the clearance compensation means 11.

Figure 4:
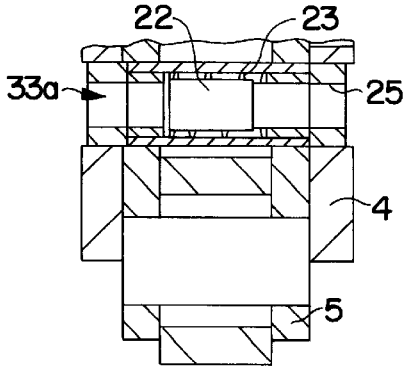
FIG. 4 is a partial sectional view of a cam follower according to FIG. 1 with an alternative configuration of the coupling means.
Figure 6E:
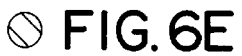
FIGS. 6E, 6F, 6G, and 6H are enlarged cross sectional views as labeled in FIG. 5.
Figure 6F:
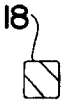
Figure 6G:
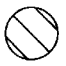
Figure 6H:
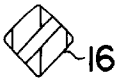

FIG. 4 shows a coupling means 22 with an alternative configuration to that of the previous embodiments. This coupling means 22 is made as a slide which, in the uncoupled state, is situated entirely in the reception 24 of the inner section 5. This slide is displaced by the means 23 in uncoupling direction and can be displaced, in the present case from the left to the right, partially into the reception 25 of the outer section 4 by hydraulic medium pressure applied to one of its ends faces.

Figure 5:
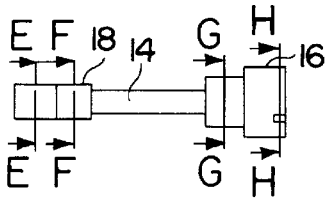
FIG. 5 is a more detailed representation of the axle.

FIG. 5 shows the axle 14, and FIGS. 6E, 6F, 6G, and 6H show the individual cross-sections in more detail.

What is claimed is:

1. A switchable cam follower (1) for a valve train of an internal combustion engine, the valve train is actuated by tappet push rods, said cam follower having the following features:

the cam follower (1) is installed in driving relationship between a camshaft and an end of the tappet push rod, said cam follower (1) comprising an outer and an inner section (4,5) as well as coupling means (22), the outer section (4) is inserted with its outer peripheral surface (6) into a reception in an engine block of the internal combustion engine, the inner section (5) being mounted in a recess (13) of the outer section (4) while being movable relative to the outer section (4), one of said sections (4 or 5) has a support (3) for the end of the tappet push rod and the other of said sections (5 or 4) has an axially opposite contacting surface (2) for a cam of the camshaft, said sections (4,5) can be coupled to each other by the coupling means (22) so that on coupling, a high lift of a valve train gas exchange valve which is loadable by the tappet push rod can be effected and, on uncoupling of the sections (4, 5) by the coupling means (22), a low lift or a zero lift of the gas exchange valve is obtainable, characterized in that the outer section (4) comprises the support (3) for the end of the tappet push rod, and the inner section (5) comprises the contacting surface (2) for the cam of the camshaft, the recess (13) for the inner section (5) in the outer section (4) is made pot-shaped, the inner section (5), at its end (15) remote from the contacting surface (2) in the recess (13), is provided with an axle (14) which is parallel to the axis of the camshaft and is guided in the outer section (4), the inner section (5) being mounted on the axle (14) for pivoting relative to the outer section (4), the inner section (5) is loaded by a spring means (35) against its direction of pivot, and the outer section (4) is made so that it can be guided non-rotatably relative to its reception in the engine block.

2. A cam follower according to claim 1, characterized in that the spring means (35) for the inner section (5) is configured as a torsion spring which is constituted by the axle (14).

3. A cam follower according to claim 2, characterized in that the axle (14) is fixed at one end by a first rotation preventing device (160 including a flattened region or a polygon in a complementary reception (17) of the outer section (4) and in a region at the axially largest distance from the first rotation preventing device (16) in the inner section (5), the axle (14) is fixed by a second rotation preventing device (18) including a flattened region or a polygon in a complementary reception (19) of the inner section (5).

4. A cam follower according to claim 1, characterized in that the coupling means (22) are configured as at least one slide, and a reception (24, 25) is arranged in each of the inner and the outer section (5, 4), said receptions (24, 25) being aligned to each other in the unpivoted state of the inner section (5) relative to the outer section (4), the receptions (24, 25) extend parallel to the axis of the camshaft and diametrically or secant-like through the cam follower (1), and the coupling means (22) extends in one of the receptions (24 or 25) and is displaceable in at least one of its directions of displacement by a servo means including a hydraulic medium while being displaceable in the respective other direction of displacement by a mechanical means (23) including at least one compression spring, or likewise by a servo means.

5. A cam follower according to claim 4, characterized in that the receptions (25) in the outer section (4) extend therethrough and the servo means can be routed to an outer end face (26) of the coupling means (22).

6. A cam follower according to claim 1, characterized in that a stop means (27) is provided for limiting the pivoting motion of the inner section (5) against its direction of pivot, and upon abutment of the inner section (5) against the stop means (27), the receptions (24, 25) for the coupling means (22) in the inner and the outer section (5, 4) are aligned to each other so that a displacement of the coupling means (22) is made possible.

7. A cam follower according to claim 6, characterized in that the stop means (27) is comprised of a bushing which is arranged in the reception (25) of the outer section (4) and projects into the recess (13) for the inner section (5) and cooperates with a stop surface (31) on the inner section (5).

8. A cam follower according to claim 4, characterized in that as viewed in a longitudinal direction of the cam follower (1), the receptions (24, 25) for the coupling means (22) are arranged axially between the axle (14) and the contacting surface (2) for the cam.

9. A cam follower according to claim 1, characterized in that the contacting surface (2) for the cam is configured as a rotatable roller (7) which is supported on the inner section (5) through a rolling or slide bearing (8) mounted on a pin (9).

10. A cam follower according to claim 1, characterized in that the non-rotatable guidance of the outer section (4) relative to the reception of the engine block is achieved by at least one body (12) projecting beyond the outer peripheral surface (6) of the outer section (4), said body (12) being adapted to be guided in a longitudinal groove of the engine block.

11. A cam follower according to claim 1, characterized in that the cam follower (1) comprises a hydraulic clearance compensation means (11).

12. A cam follower according to claim 11, characterized in that the support (3) for the tappet push rod is configured at the same time as a pressure piston of the clearance compensation means (11) or is connected thereto, and the support (3) including the pressure piston extends in an end bore (10) of the outer section (4) facing the tappet push rod.

* * * * *